US011877666B2

(12) United States Patent
Styrc

(10) Patent No.: US 11,877,666 B2
(45) Date of Patent: Jan. 23, 2024

(54) CUSHION PROTECTOR FOR OUTDOOR FURNITURE

(71) Applicant: 2724889 ONTARIO INC., Oakville (CA)

(72) Inventor: Jacek Styrc, Oakville (CA)

(73) Assignee: 2724889 ONTARIO INC., Oakville (CA)

( * ) Notice: Subject to any disclaimer, the term of this patent is extended or adjusted under 35 U.S.C. 154(b) by 0 days.

(21) Appl. No.: 17/881,109

(22) Filed: Aug. 4, 2022

(65) Prior Publication Data

US 2023/0059397 A1 Feb. 23, 2023

Related U.S. Application Data

(60) Provisional application No. 63/233,967, filed on Aug. 17, 2021.

(51) Int. Cl.
*A47C 31/11* (2006.01)

(52) U.S. Cl.
CPC ..... *A47C 31/113* (2013.01)

(58) Field of Classification Search
None
See application file for complete search history.

(56) References Cited

U.S. PATENT DOCUMENTS

| | | | | | |
|---|---|---|---|---|---|
| 4,059,306 | A * | 11/1977 | Harder, Jr. | B60N 2/5825 | 297/440.22 |
| 4,232,899 | A * | 11/1980 | Fister, Jr. | A47C 31/023 | 297/229 |
| 5,023,125 | A * | 6/1991 | Gray | B60N 2/5833 | 297/DIG. 6 |
| 5,275,463 | A * | 1/1994 | Rocha | A47C 1/14 | 297/229 |
| 6,676,210 | B1 * | 1/2004 | Peyton | A47C 31/11 | 297/DIG. 6 |
| 7,222,915 | B2 * | 5/2007 | Philippot | B60N 2/5825 | 297/452.59 |
| 10,856,669 | B2 | 12/2020 | Lin et al. | | |
| 2004/0075315 | A1 * | 4/2004 | Patrick | A47C 31/11 | 297/219.1 |
| 2005/0236874 | A1 * | 10/2005 | Godshaw | B60N 2/6009 | 119/28.5 |
| 2006/0033367 | A1 * | 2/2006 | Sweeney | A47C 3/04 | 297/239 |
| 2008/0284217 | A1 | 11/2008 | Noonan | | |
| 2010/0176635 | A1 * | 7/2010 | Glance | B60N 2/5833 | 297/250.1 |
| 2015/0230617 | A1 | 8/2015 | Yawe | | |
| 2020/0154903 | A1 | 5/2020 | Lin et al. | | |
| 2020/0337473 | A1 | 10/2020 | Burt | | |

* cited by examiner

*Primary Examiner* — David E Allred
(74) *Attorney, Agent, or Firm* — Bhole IP Law; Anil Bhole; Marc Lampert

(57) ABSTRACT

A cover for cushions of a seat. The cover has a major panel with spaced longitudinal edges and a pair of side panels. The side panels have a curvilinear upper edge secured to the longitudinal edges to constrain the major panel to define a domed configuration. The major panel extends beyond the side panels to have a pair of flaps to overlie a seat frame and has releasable fasteners to secure the cover to the seat frame.

8 Claims, 8 Drawing Sheets

CUSHION PROTECTOR FOR OUTDOOR FURNITURE

FIELD OF THE INVENTION

The present invention relates to furniture.

DESCRIPTION OF THE PRIOR ART

Furniture is a staple product and covers a wide range of products and configurations. One pre-requisite is that it is sturdy and capable of withstanding the environment in which it is placed. This is particularly so where the furniture is to be used outdoors and may be exposed to adverse climatic conditions.

One of the more common components of outdoor furniture is a seat, which may be a chair intended for a single component or a sofa intended for multiple occupants. The seats must be comfortable and so have compliant surfaces to support the user. Conventional upholstery techniques are impractical where the furniture is to be left exposed to the elements and so outdoor seating frequently uses a frame and one or more cushions that are placed on and supported by the frame.

The cushions are particularly vulnerable to adverse weather such as rain, and to the accumulation of debris such as leaves and so it is preferable to remove and store the cushions when not in use. This however is time consuming and inconvenient where the furniture is in frequent use.

It has previously been proposed to provide a cover for the furniture to protect cushions. One such example is US patent application 2008/0284217 to Noonan which has a cover secured to a roller mechanism to allow deployment and retraction of the cover. This arrangement however requires the roller to be secured to the ground and so inhibits movement of the furniture to different locations.

US patent application 2020/0337473 to Burt has a cover with panels that cover the seat portion and the back. The cover is held in situ by a rod located at the intersection of the seat and back cushions. Whilst more convenient than the Noonan arrangement, the cover is not readily removed and leads to accumulation of debris and rain water where the rod is located.

US patent application 2021/0085093 to Lin shows a cover that extends over an entire seat and accommodates cushions between the upstanding arms. However this requires a custom cover for each style of furniture and has excess material that may lead to pooling of water and collection of debris, as well as being bulkier to store.

It is an object of the present invention to provide a furniture system that obviates or mitigates the above disadvantages.

SUMMARY OF THE INVENTION

In general terms the present invention provides a cover for cushions of a seat. The cover has a major panel with spaced longitudinal edges and a pair of side panels. The side panels have a curvilinear upper edge secured to the longitudinal edges to constrain the major panel to define a domed configuration. The major panel extends beyond the side panels to have a pair of flaps to overlie a seat frame and has releasable fasteners to secure the cover to the seat frame.

In a further aspect, the present invention provides a seat having a frame with a seat portion and a back. A pair of cushions are provided to be supported on the seat portion and the frame respectively and a cover to protect the cushions when stacked on the seat portion. The cover has a major panel with spaced longitudinal edges and a pair of side panels. The side panels have a curvilinear upper edge secured to the longitudinal edges to constrain the major panel to define a domed configuration. The major panel extends beyond the side panels to have a pair of flaps to overlie the seat frame and has releasable fasteners to secure the cover to the seat frame which is adapted to accommodate the releasable fasteners.

BRIEF DESCRIPTION OF THE DRAWINGS

The features of the invention will become more apparent in the following detailed description in which reference is made to the appended drawings wherein.

DETAILED DESCRIPTION OF THE INVENTION

Figure 1:
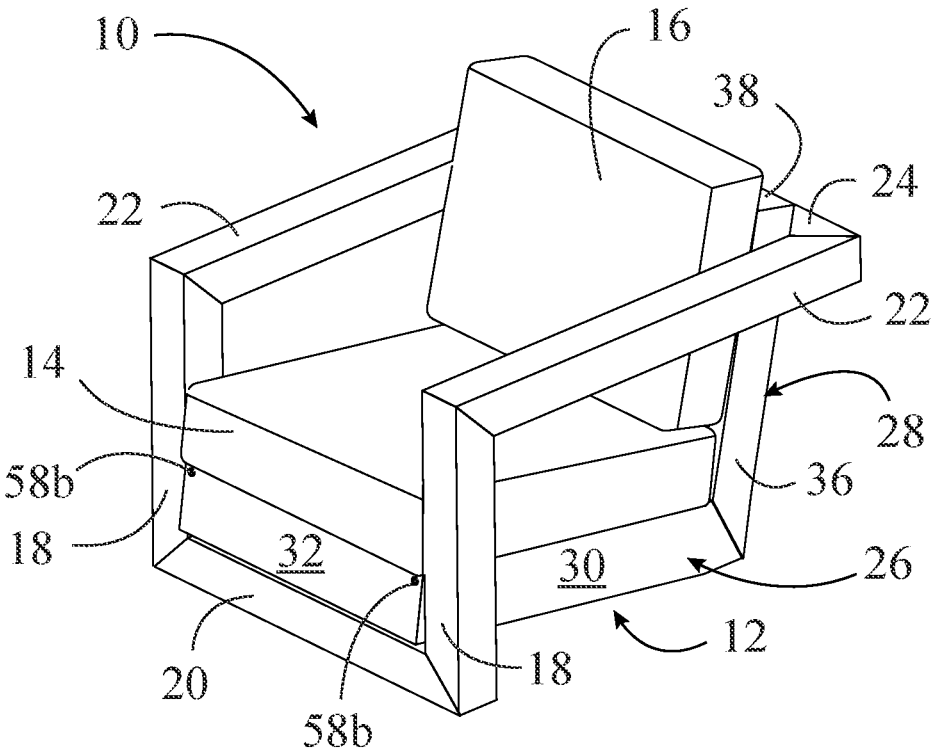
FIG. 1 is a front perspective view of a chair.
Figure 2:
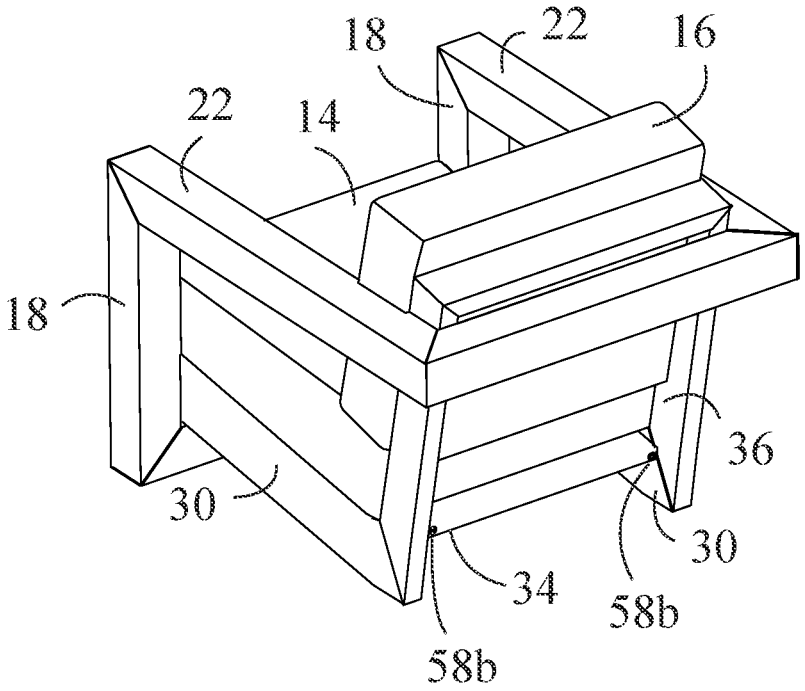
FIG. 2 is a rear perspective view of the chair of FIG. 1.

Referring firstly to FIGS. 1 and 2, a seat configured as a chair 10 has a seat frame 12 and cushions 14, 16. The seat frame 12 has a pair of legs 18 extending upwardly from opposite ends of a lower cross member 20. A pair of arms 22 extend rearwardly from the legs 18 and are connected by an upper cross member 24.

A base 26 is supported on the lower cross member 20 and extends rearwardly and downwardly to a back 28. The back 28 is supported on the upper cross member 24 so the base 26 and back define an L shaped support structure between the legs 18 and arms 22.

The base 26 has a peripheral frame with a pair of longitudinal frame members 30 that are secured to the legs 18. The longitudinal frame members are connected by a front frame member 32 and a rear frame member 34.

The back 28 has a pair of upright frame members 36 extending from the longitudinal frame members 30 to the upper cross member 24. The upright frame members 36 are connected by a top frame member 38.

Support surfaces for the cushions 14, 16 are provided by slats 50 (FIG. 5) that extended between the longitudinal frame members 30 in the base 26 and between the upright frame members 36 in the back 28.

It will be appreciated that the configuration and structure of the seat is exemplary and other configurations may be used. Multiple occupants can be accommodated by providing a sofa rather than a chair and different styles of legs and arms may be used.

The cushions 14, 16 typically have a closed cell foam core with an outer fabric covering that is preferably mildew and UV resistant. The cushions are supported on the base 26 and back 28 and may be removed for storage as required. Typically the back cushion 16 is shorter than the seat cushion 14 so that the back cushion can be folded on to the seat cushion and lie within the periphery of the seat cushion.

Figure 3:
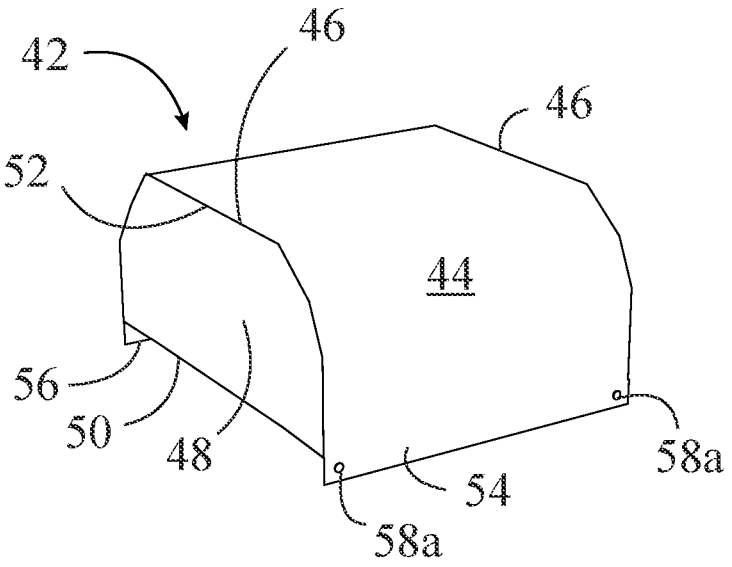
FIG. 3 is a perspective view of a cover.
Figure 4:
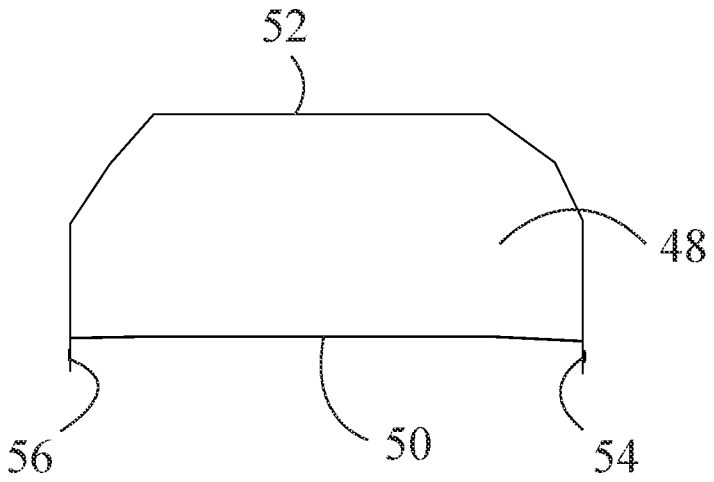
FIG. 4 is a side view of the cover of FIG. 3.

A cover 42 is provided to provide protection for the cushions 14, 16 on the chair 10. The cover is shown in FIGS. 3 and 4 and has a major panel 44 with a pair of longitudinal edges 46. A pair of side panels 48 are secured to respective ones of the longitudinal edges 46, such as by stitching, to provide a unitary structure. The side panels 48 have a linear lower edge 50 and a curvilinear upper edge 52 which is secured to the longitudinal edges 46. The upper edges 52 conform the major panel 44 to a domed configuration to provide a surface that slopes toward the edges of the cover 40 to dispel water.

The height of the side panels 48 is greater than the combined thickness of the cushions 14, 16 and the curvature of the upper edge 52 is chosen so that both cushions can be accommodated within the cover when stacked one on top of the other.

The major panel 44 extends beyond the side panels 48 to provide a pair of flaps 54, 56 extending below the side panels 48. A separable fastener 58 having a pair of components 58*a*, 58*b* is provided to connect the flap 54, 56 to an adjacent one of the frame members 32, 34. In the preferred embodiment a "snap" fastener, such as those sold under the trade name Arrow, is used as it provides a low profile and smooth surface that does not interfere with normal use of the chair. One of the components 58*a* of the snap fastener 58 is secured proximate each lateral edge of said flap and preferably adjacent a corner of the flaps 54, 56 in a position in which they will overlie either the front or rear frame members 32, 34 of the base 26. The other component 58*b* of the snap fastener 58 is secured to the front and rear frame members in the appropriate location for connection to the one part. Additional snap fasteners 58 could be disposed intermediate the corner snap fasteners, particularly for a longer cover, for example intended for a sofa.

The other component 58*b* of the snap fastener 58 is located on an outwardly directed face of the frame members 32, 34 so that the flaps 54, 56 are secured in position outwardly of and over the frame members 32, 34 to assist in shedding water.

The cover 40 is made from a suitable fabric material such as a breathable outdoor fabric or water impermeable fabric that is flexible but preferably has sufficient stiffness to retain the desired shape of the cover. The material is preferably water repellent or impermeable to keep the cushions dry with the domed shape of the cover 40 assisting in drainage of water.

Figure 5:
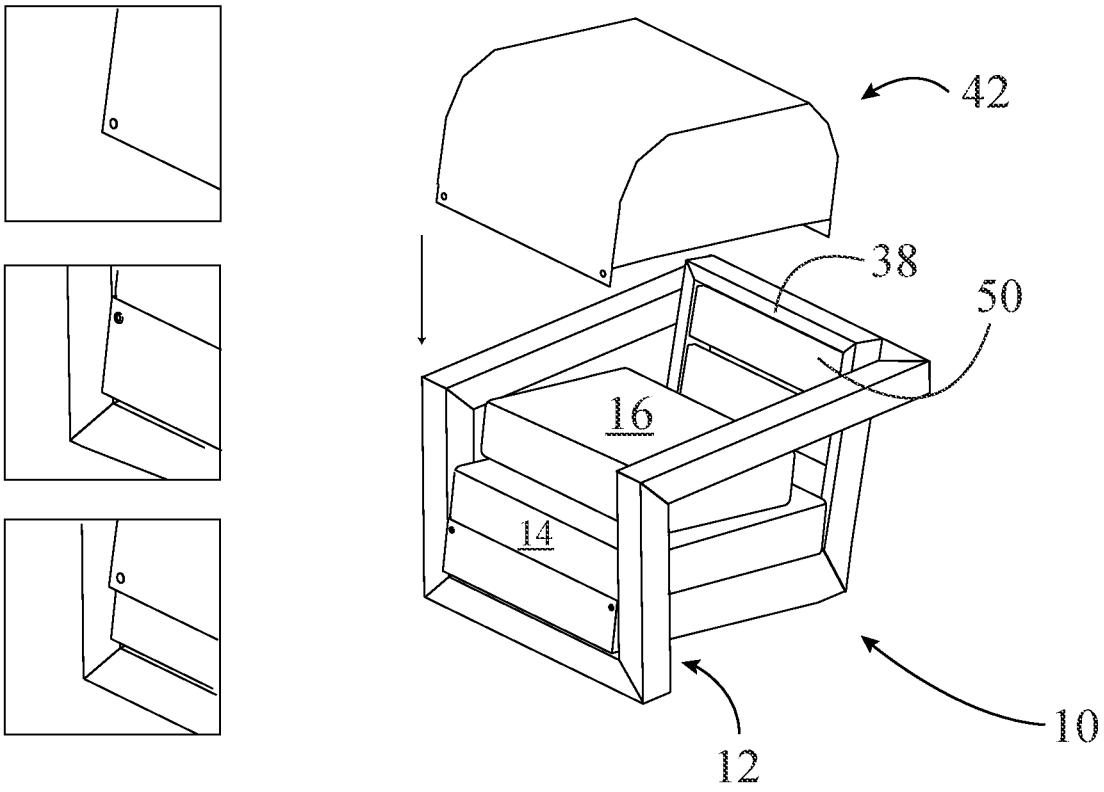
FIG. 5 is a front perspective view of a chair of FIG. 1 with the cover of FIG. 3 positioned for installation.
Figure 6:
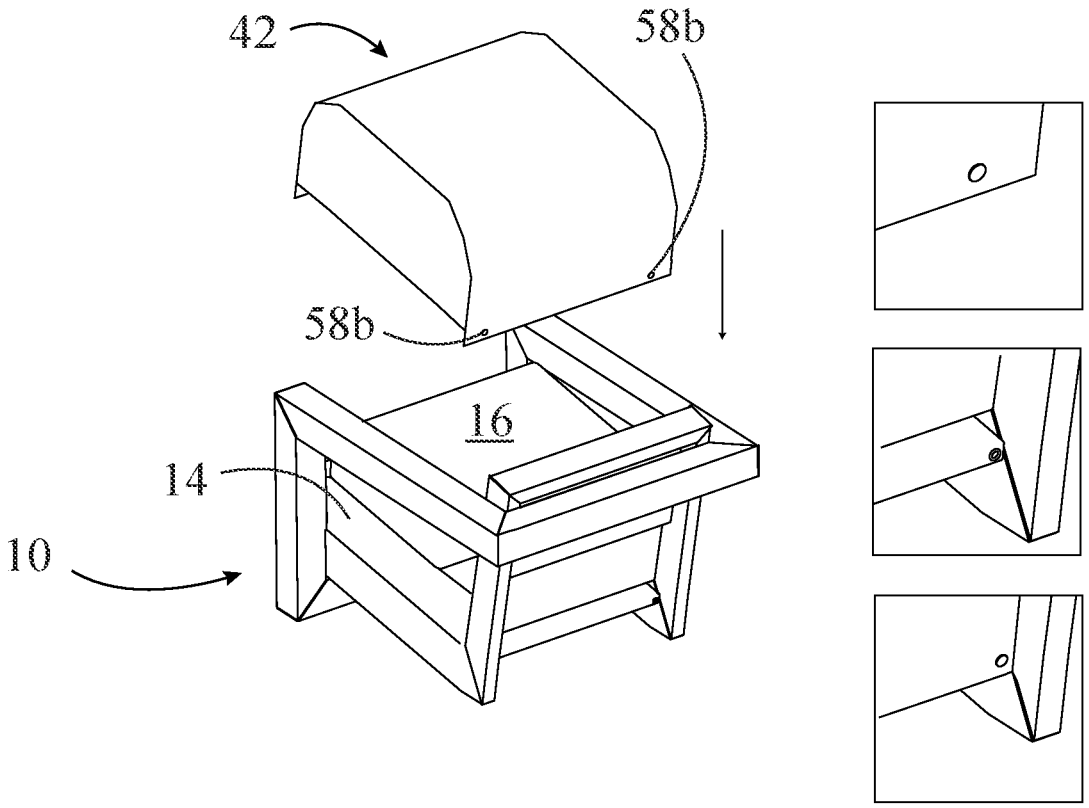
FIG. 6 is a rear perspective view of the FIG. 5.
Figure 7:
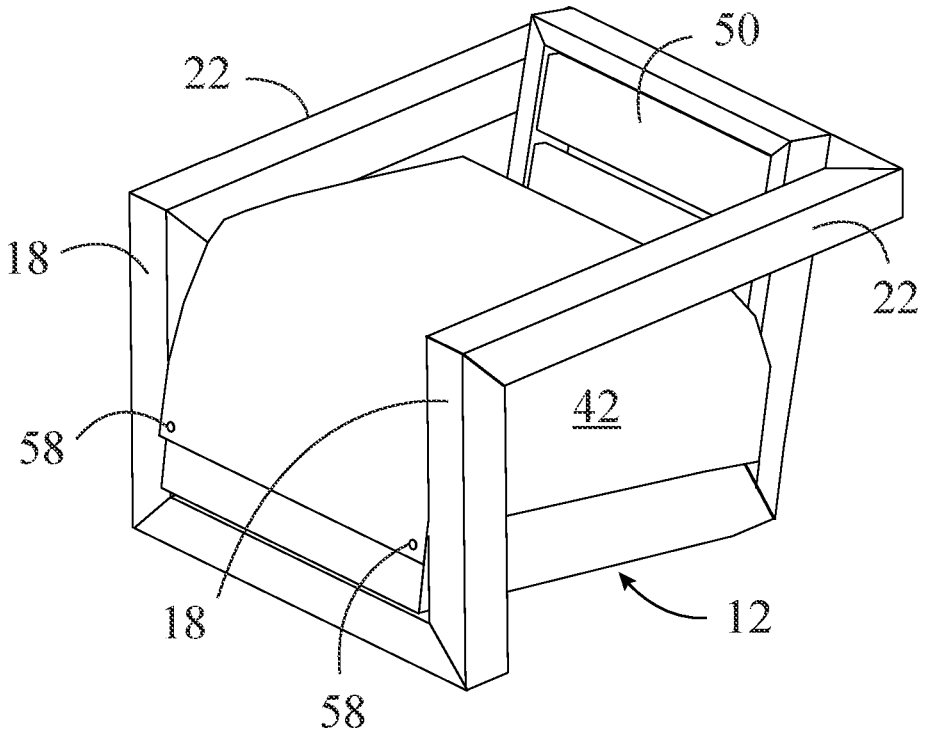
FIG. 7 is front perspective view of the chair of FIG. 1 with the cover of FIG. 3 installed.
Figure 8:
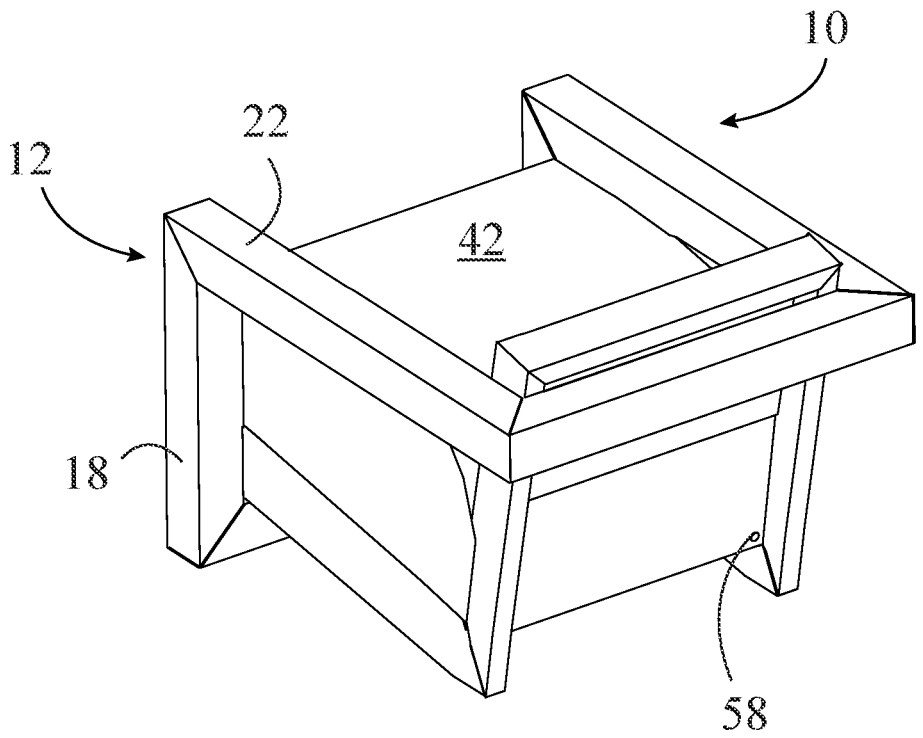
FIG. 8 is a rear perspective view of FIG. 7.

To install the cover 40, as shown in FIGS. 5 and 6, the cushion 16 is folded on to the cushion 14. The cover 40 is then positioned with the side panels 48 aligned with the arms 22 and the flaps 54, 56 aligned with the front and rear frame members 32, 34. The cover 40 may then be lowered over the stacked cushions until the flaps 54, 56 overlie the front and rear frame members 32, 34. The separated components of the snap fasteners 58 are then connected to secure the cover in place. The side panels 48 are positioned between the cushions 14, 16 and the arms and extend to the lower edge of the cushion 16, or preferably just below the edge, to direct water past the cushions. When installed, the domed configuration of the major panel 46 provides a high point for the cover above the seat portion and promote the flow of water from the panel to the front and rear of the seat, In practice it is found preferable to initially secure the flap 56 to the rear frame member 34 and then manoeuvre the cover over the cushions 14, 16 until the flap 54 overlies the front cross member 32.

To remove the cover 40, it is simply necessary to undo the snap fasteners 58 and pull the cover off the cushions 14, 16. It is however also convenient to release the front fasteners 58 and withdraw the cover 40 behind the back 28 where it can be stored until needed.

It is seen therefore that the cover 40 provides protection for the cushions while securing them to the seat.

Although snap fasteners are described in the above embodiments, it will be apparent that other forms of fastener may be used. For example, a magnet may be embedded in the frame member and a magnetic material attached to the flap to secure the flap to the frame. Alternatively of course the magnet may be attached to the flap and a magnetic material secured to the frame member. As a further alternative, twist toggles may be mounted on the frame member and a hole provided in the flap to receive the toggle. Further options include a D-ring on the frame members and a hook on the flap, or a hook and loop tape on each of frame members and flap.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

I claim:

1. A seat assembly including a seat having a frame with front and rear transverse frame members, a seat portion and a back, a pair of cushions to be supported on the seat portion and the back respectively and a cover configured to protect the cushions when stacked on the seat portion, said cover having a major panel with spaced longitudinal edges and a pair of side panels, each of said side panels having a curvilinear upper edge secured to a respective one of the longitudinal edges of the major panel to constrain the major panel to define a domed configuration, front and rear ends of said major panel each extending downward beyond the side panels to form a pair of flaps configured to overlie respective ones of said transverse frame members of said seat and releasable fasteners acting between said transverse frame members and said flaps to secure the cover to the seat.

2. The seat assembly of claim 1 wherein said flaps are located outwardly of said transverse frame members and said fasteners act between an outwardly directed face of said transverse frame members and said flaps.

3. The seat assembly of claim 2 wherein components of a pair of fasteners are located on each flap at spaced locations.

4. The seat assembly of claim 3 wherein said components are located adjacent lateral edges of said flaps.

5. The seat assembly of claim 4 wherein said components are located adjacent respective corners of said flaps.

6. The seat assembly of claim 1 wherein said fasteners are snap fasteners.

7. The seat assembly of claim 1 wherein said major panel and said side panel is made from a water repellent material.

8. The seat assembly of claim 1 wherein said side panels have a height above said seat portion that is greater than the combined thickness of said cushions and the curvature of the upper edge is chosen so that both cushions can be accommodated within the cover when stacked one on top of the other on the seat portion.

* * * * *